US007232368B2

(12) United States Patent
Kennedy et al.

(10) Patent No.: US 7,232,368 B2
(45) Date of Patent: Jun. 19, 2007

(54) MINE VENTILATION

(75) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 599 days.

(21) Appl. No.: 10/266,182

(22) Filed: Oct. 7, 2002

(65) Prior Publication Data

US 2004/0067730 A1 Apr. 8, 2004

(51) Int. Cl.
*E21F 1/14* (2006.01)

(52) U.S. Cl. ..... 454/169; 454/168; 405/132; 405/150.1

(58) Field of Classification Search ..... 454/168, 454/169, 170; 405/132, 150.1, 150.2, 151, 405/152, 153; 52/489
See application file for complete search history.

(56) References Cited

U.S. PATENT DOCUMENTS 3,332,182 A * 7/1967 Mark ..... 52/127.12
3,731,956 A * 5/1973 Hanley ..... 52/481.2
3,820,294 A * 6/1974 Parker ..... 52/262
3,866,381 A * 2/1975 Eschbach et al. ..... 52/731.3
4,096,702 A * 6/1978 Burton ..... 405/132
4,464,084 A * 8/1984 Wozniak ..... 405/288
4,515,501 A * 5/1985 Thomas ..... 405/153
4,621,948 A * 11/1986 Hentschel ..... 405/146
4,621,951 A 11/1986 Dewson
RE32,675 E 5/1988 Kennedy et al.
4,820,081 A 4/1989 Kennedy et al.
4,930,937 A * 6/1990 Fulton ..... 405/149
5,174,682 A 12/1992 Whitfield
5,279,088 A 1/1994 Heydon
5,412,916 A * 5/1995 Kennedy et al. ..... 52/262
5,466,187 A 11/1995 Kennedy et al.
5,758,461 A * 6/1998 McManus ..... 52/293.3
5,879,231 A * 3/1999 Sisk ..... 454/169
6,256,946 B1 7/2001 Kennedy et al.
6,264,549 B1 7/2001 Kennedy et al.
6,457,906 B1 * 10/2002 Kennedy et al. ..... 405/151

OTHER PUBLICATIONS

Kennedy Interlocking Overcasts brochure, Jack Kennedy Metal Products & Buildings, Inc., 2000.

* cited by examiner

*Primary Examiner*—Derek S. Boles
(74) *Attorney, Agent, or Firm*—Senniger Powers

(57) ABSTRACT

A mine air crossing includes opposite side walls and a deck extending from side wall to side wall. Each side wall includes a plurality of sections assembled side-by-side and interconnected by quick-connections. Similarly, each deck may include deck sections assembled side-by-side and interconnected by quick-connections.

27 Claims, 12 Drawing Sheets

MINE VENTILATION

BACKGROUND OF THE INVENTION

This invention relates generally to mine ventilation, more particularly to mine overcast and mine undercast structures (generally, mine air crossings), i.e., a structure for the intersection of two passageways or airways in a mine wherein air is flowing in each passageway or airway for ventilation, the installation thereof in the mine as completed functioning to by-pass air flowing in one airway over the other airway at the intersection to avoid interference of one flow with the other, and the method of installation.

Reference is made to the co-assigned U.S. Pat. No. 5,412,916 of William R. Kennedy and John M. Kennedy dated May 9, 1995 entitled "Structure Having Quick-Connect Components", U.S. Pat. No. 5,466,187 of John M. Kennedy and William R. Kennedy dated Nov. 14, 1995 entitled "Mine Ventilation Structure", U.S. Pat. No. 6,256,946 B1 of William R. Kennedy and John M. Kennedy dated Jul. 10, 2001 and U.S. Pat. No. 6,264,549 B1 of William R. Kennedy and John M. Kennedy dated Jul. 24, 2001 for background on mine overcasts and undercasts (including their function and prior overcast structure). Reference is also made to the co-assigned U.S. patent application Ser. No. 10/038,356 of William R. Kennedy and John M. Kennedy filed Jan. 4, 2002 entitled "Mine Ventilation Structure and Deck Panels Therefor". All these patents and applications are incorporated herein by reference. And reference is further made to the book titled "Practical Mine Ventilation" by William R. Kennedy, Second Edition published 1999 by Intertec Publishing Corporation of Chicago, Ill.

SUMMARY OF THE INVENTION

Among the several objects of the present invention may be noted the provision of a mine air crossing structure which reduces the time and labor involved in the installation of the structure down in a mine at the intersection of two intersecting airways in the mine, thereby effecting substantial savings in labor cost and making the installation less laborious for workmen carrying it out; and the provision of a labor-saving method of making the installation.

Briefly, apparatus of this invention is a mine air crossing comprising opposite side walls and a deck extending from side wall to side wall. Each side wall comprises a plurality of sections each having a top, bottom and sides. The sections in each side wall are assembled side-by-side and interconnected to form the respective side wall by quick-connections.

In another aspect of the invention, each side wall comprises a plurality of sections and the deck comprises a plurality of deck sections. The side wall sections are assembled side-by-side, and the deck sections are assembled side-by-side. At least some of the deck sections are interconnected to form the deck by quick-connections.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
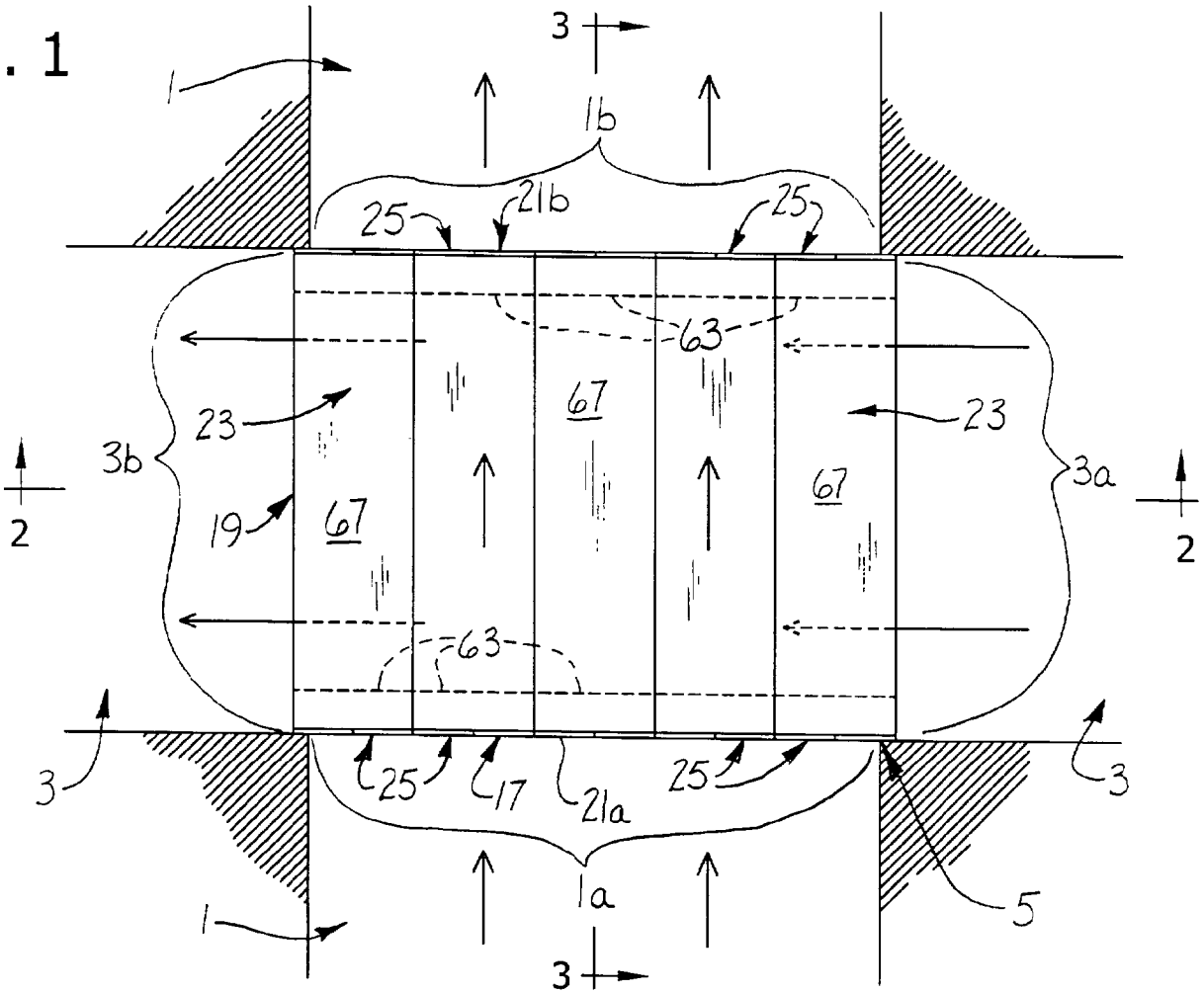
FIG. 1 is a view generally in horizontal section on the plane of the roof of two intersecting passageways or airways of a mine looking down, taken generally on line 1—1 of FIG. 2, showing an overcast construction of an embodiment of this invention at the intersection of the passageways (or airways)

Referring to the drawings, first more particularly to FIG. 1, indicated at 1 and 3 are two intersecting passages in a mine, typically a coal mine, each passage constituting an airway for flow of air as indicated by the arrows in FIG. 1 for mine ventilation. Each airway has an upstream and downstream mouth at the intersection, the intersection being generally indicated by the reference numeral 5, the upstream and downstream mouths of airway 1 being indicated at 1*a* and 1*b*, respectively, and the upstream and downstream mouths of airway 3 being indicated at 3*a* and 3*b*, respectively. The floor in the airways and the intersection is indicated at 7, and the roof in the airways and intersection is indicated generally at 9 (see FIGS. 2 and 3), the exemplary roof shown having a dome formation 11 extending from a point 13 somewhat upstream of the upstream mouth 1*a* of airway 1 to a point 15 somewhat downstream of the downstream mouth 1*b* of airway 1 (see FIG. 3). Airway 1 is shown as somewhat wider than airway 3; it will be understood that the airways may be of substantially the same width. It will further be understood that the roof 9 may have other than a dome formation, e.g., it may be cut square (same width all the way across).

Occupying the intersection 5 is an overcast (generally, air crossing) construction designated in its entirety by the reference numeral 17 built in accordance with this invention comprising a tunnel-forming overcast structure designated in its entirety by the reference numeral 19. This tunnel structure comprises a pair of generally parallel opposite side walls, designated in their entirety by the reference numeral 21*a* and 21*b*, each being of such width as to wall off at least portions of a respective mouth 1*a*, 1*b* of airway 1, and further comprising a deck designated in its entirety by the reference numeral 23 extending from side wall 21*a* to side wall 21*b* at or adjacent the top and connected thereto as will be described. It is contemplated within the scope of the invention that the deck extend between the side walls, e.g., the deck may rest on connectors, such as rivets, (not shown) extending from the side walls, rather than resting on top of the side walls as shown.

Figure 2:
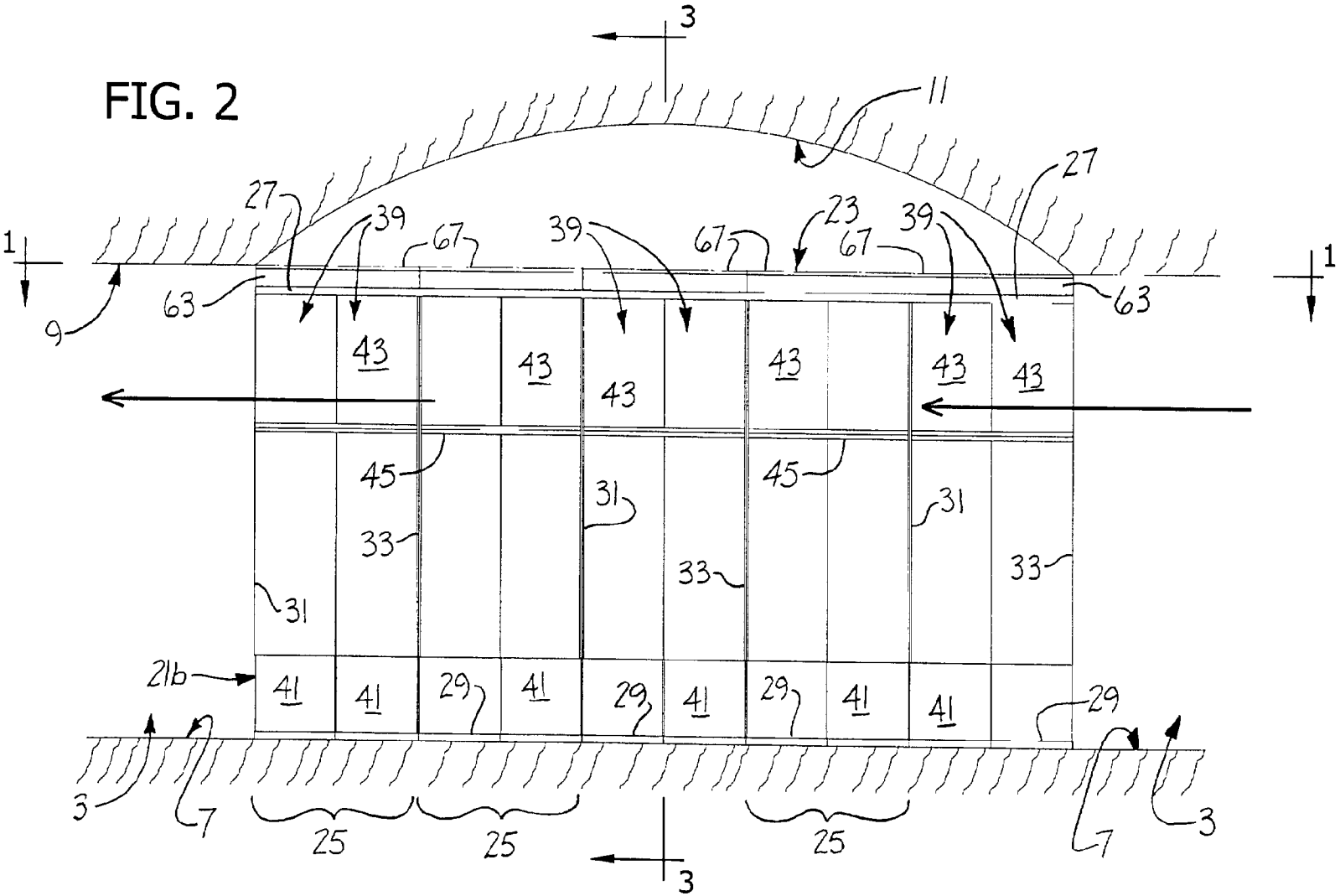
FIG. 2 is a view generally in vertical section on the central vertical longitudinal plane of one of the passages, taken generally on line 2—2 of FIGS. 1 and 3.
Figure 3:
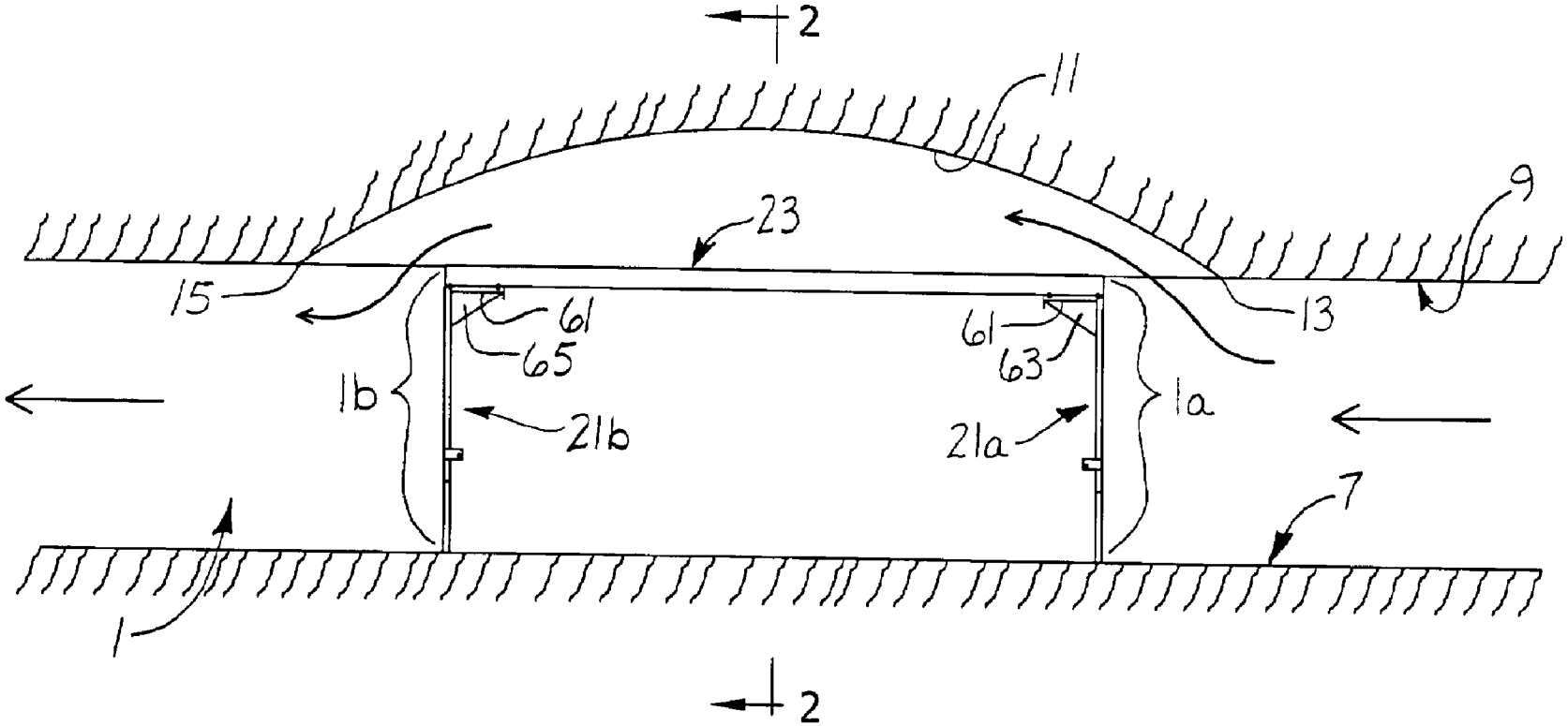
FIG. 3 is a view generally in vertical section on the central vertical plane of the other passage, taken generally on line 3—3 of FIGS. 1 and 2.

Referring to FIG. 2, each of the opposite side walls 21*a*, 21*b* of the tunnel 19 comprises a plurality of sections (side wall sections), each section being designated in its entirety by the reference numeral 25, each section having a top 27, bottom 29 and sides 31 and 33. The wall sections 25 in each side wall 21*a*, 21*b* are assembled side-by-side and interconnected to form the respective side wall by quick-connections. More particularly, the sections are interconnected in side-by-side assembly by quick-connection elements 35, 37 on sides 31, 33 of the sections which generally abut one another in the assembly.

Figure 4:
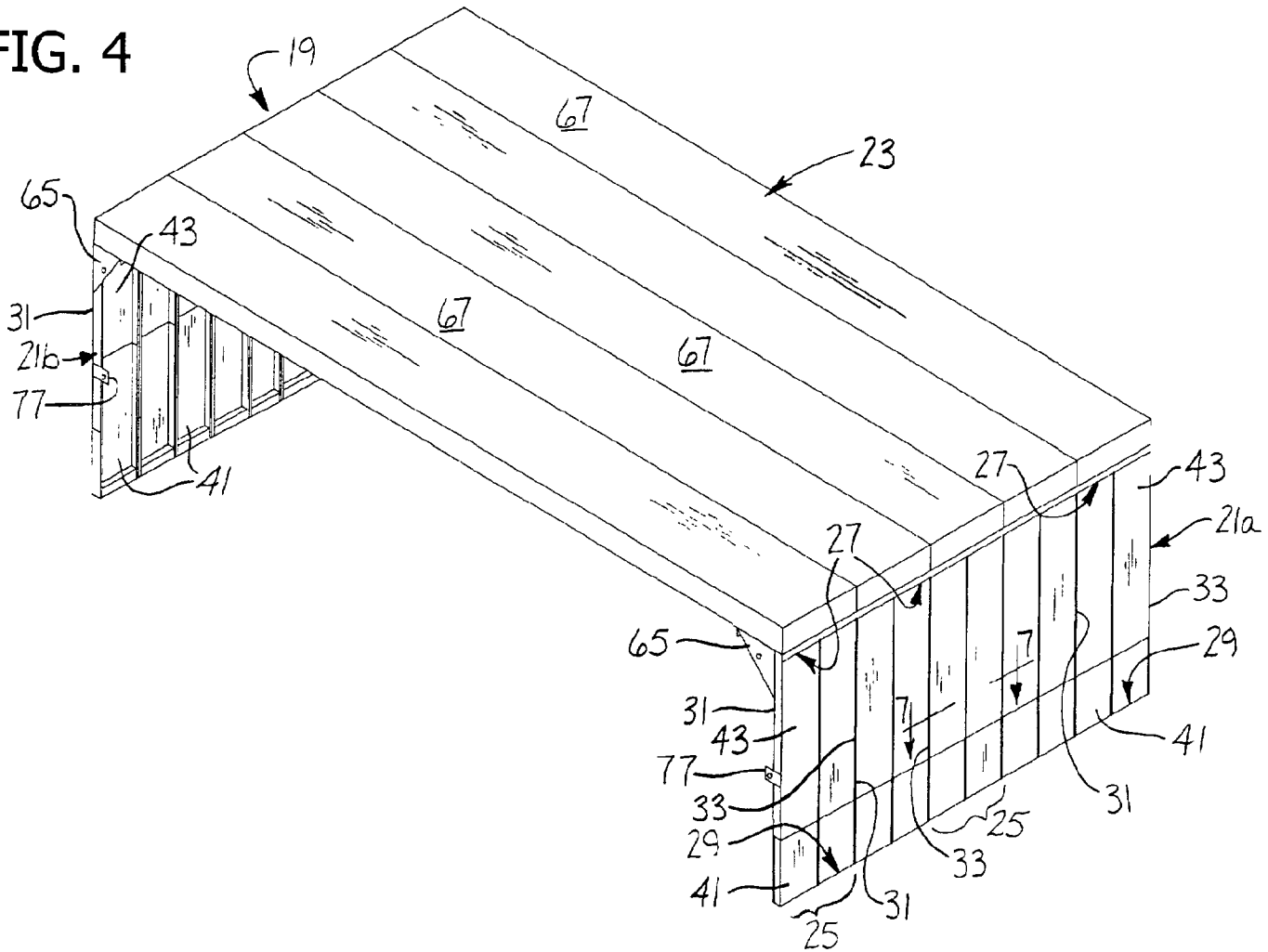
FIG. 4 is a view generally in perspective of a completed tunnel-forming overcast of an embodiment of the invention.
Figure 7:
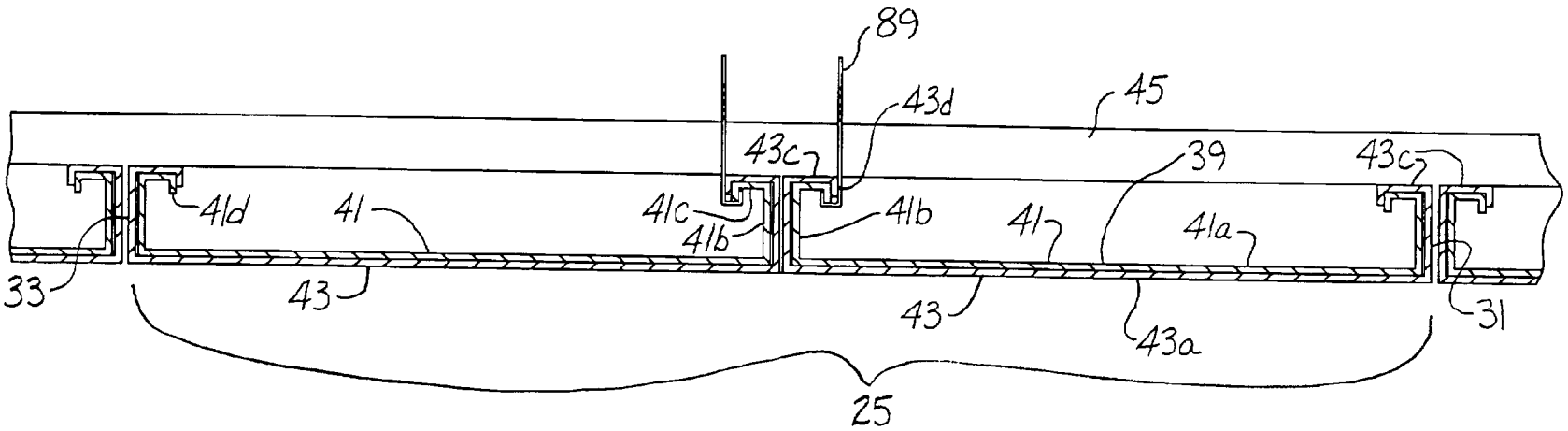
FIG. 7 is a view generally in horizontal section on line 7—7 of FIG. 4 on a larger scale than FIG. 4.
Figure 8:
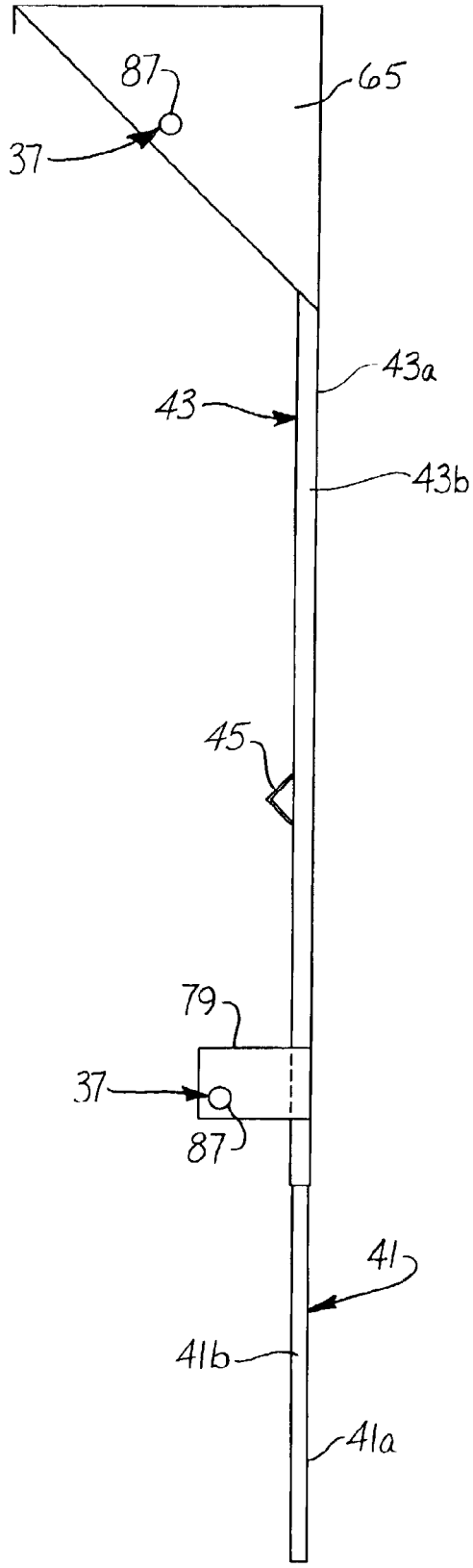
FIG. 8 is an enlarged fragment of FIG. 3, being generally in elevation on each line 8—8 of FIG. 6.
Figure 9:
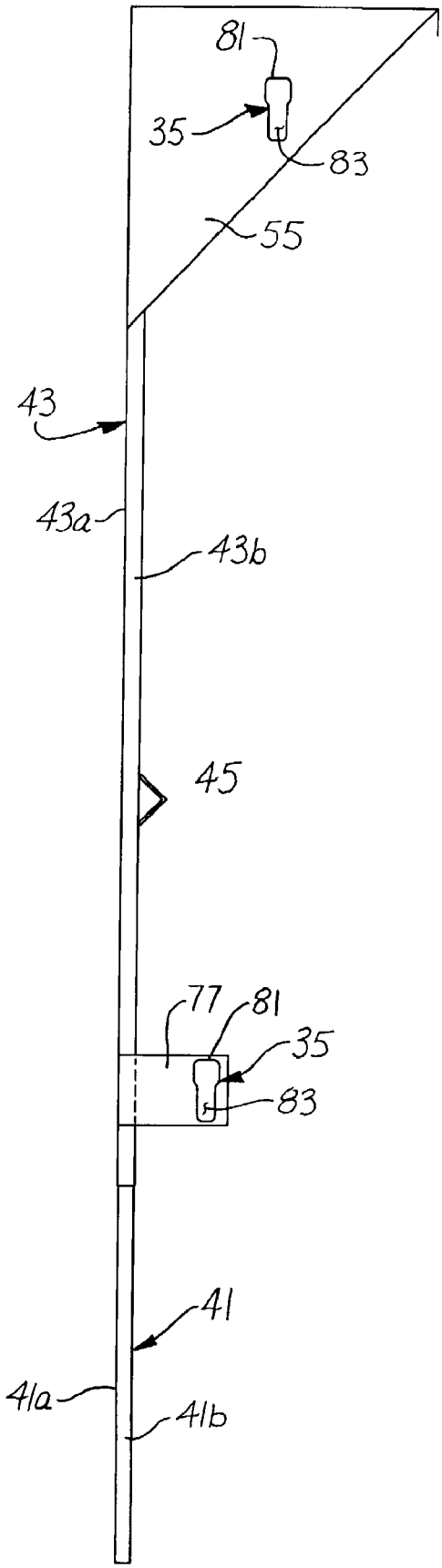
FIG. 9 is a view generally in elevation on each line 9—9 of FIG. 6 on a larger scale than FIG. 6.

Referring to FIGS. 2, 4 and 7, each side wall section 25 preferably comprises a plurality of elongate vertically extensible panels, each panel being designated 39 in its entirety, the panels being in side-by-side relation. Note that solid, non-extensible panels are contemplated. For simplicity as herein illustrated, each section 25 is shown as comprising two of the extensible panels 39 side-by-side. Any number of panels, including just one, per section is contemplated. In this embodiment, each of the extensible panels 39 is generally similar to the panel used in the mine stopping shown in the coassigned U.S. Reissue Pat. No. RE 32,675 dated May 24, 1988 and in U.S. Pat. No. 4,820,081 dated Apr. 11, 1989 of John M. and William R. Kennedy, both of which are incorporated herein by reference. Each panel 39 comprises a lower member 41 having a telescoping sliding fit in an upper member 43. Each of the panel members 41, 43 is preferably a sheet metal member generally of channel shape in cross-section having a web and flanges, each flange having an inturned portion and lip (similar to web 21, flanges 23, inturned portions 25 and lips 27 of RE 32,675). As to each lower panel member 41, its web is designated 41*a*, each flange 41*b*, each inturned portion 41*c* and each lip 41*d*. As to each upper panel member 43 (which is slidably extensible in member 41), its web is designated 43*a*, each flange 43*b*, each inturned portion 43*c* and each lip 43*d*. Other types of panel members and panels are contemplated, including non-extensible panels. Extending across each side wall section 25 from one side (e.g. 31) to the other (e.g. 33) on what is the inside thereof as the section is incorporated in the tunnel 19 and at a level which is above the upper ends of the lower panel members 41 (when extended) is preferably a cross-bar 45, e.g. an angle iron. Preferably, the cross-bar 45 is welded to the outside inturned portions 43*c* of the upper panel members 43 in the section. Initially, as fabricated and prior to incorporation in a tunnel side wall, the lower (inside) members 41 are capable of downward (and upward) sliding adjustment in the upper members 43 free of the cross-bar.

By way of example, each of the side walls of the tunnel 19 comprises at least three, e.g., five, of the sections 25 (the size and number of the sections may vary). Again, by way of example, each of the five sections 25 is generally two feet wide so that each side wall 21*a* and 21*b* and the tunnel 19 is generally ten feet long. Preferred section widths will range from about 4 feet to about 30 feet. Preferred section heights will range from about 3 feet (unextended) to about 30 feet (fully extended).

Figure 5:
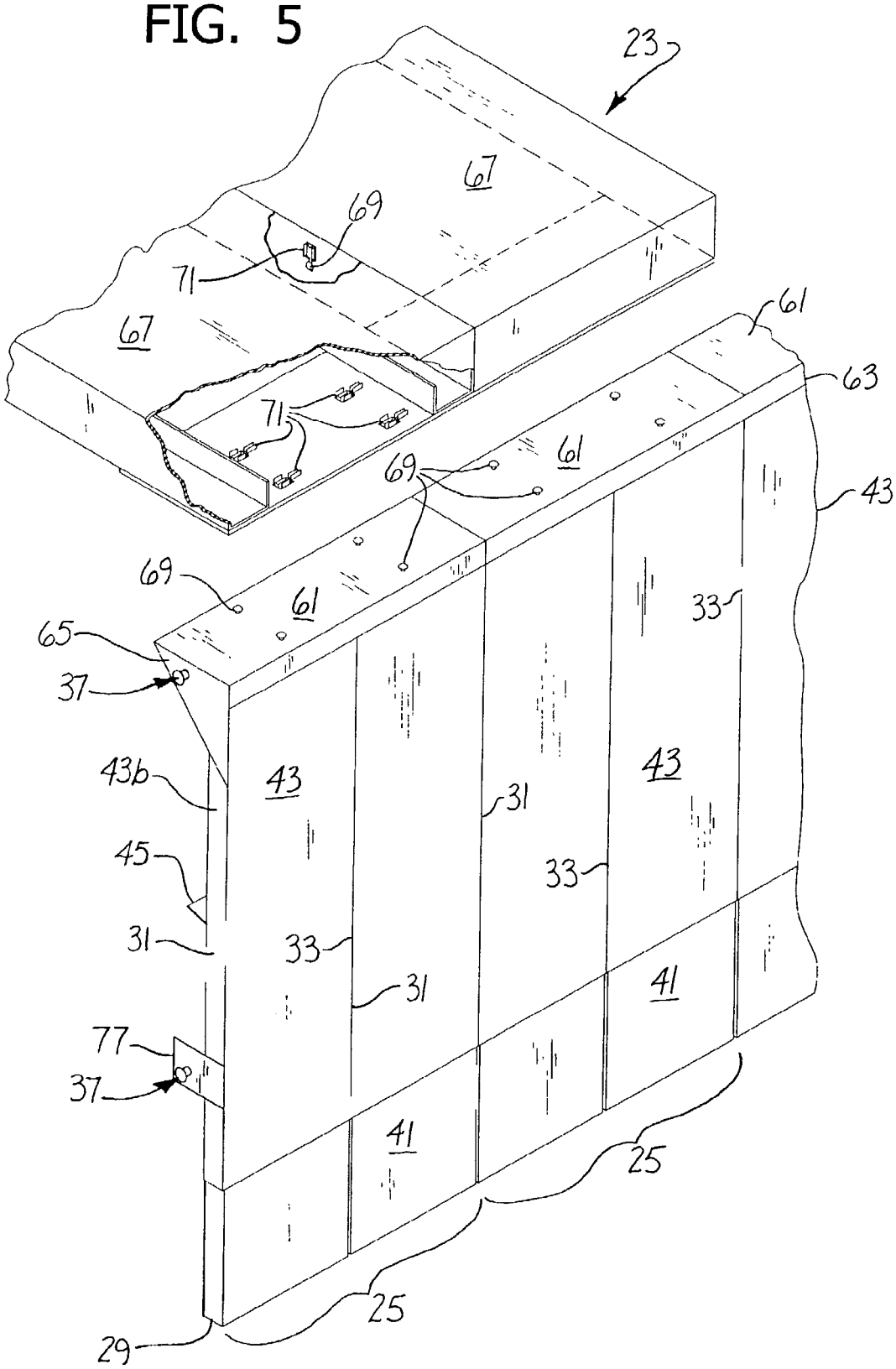
FIG. 5 is a fragmentary exploded perspective showing part of a side wall and decking of the overcast and illustrating a step in a method of the invention.
Figure 6:
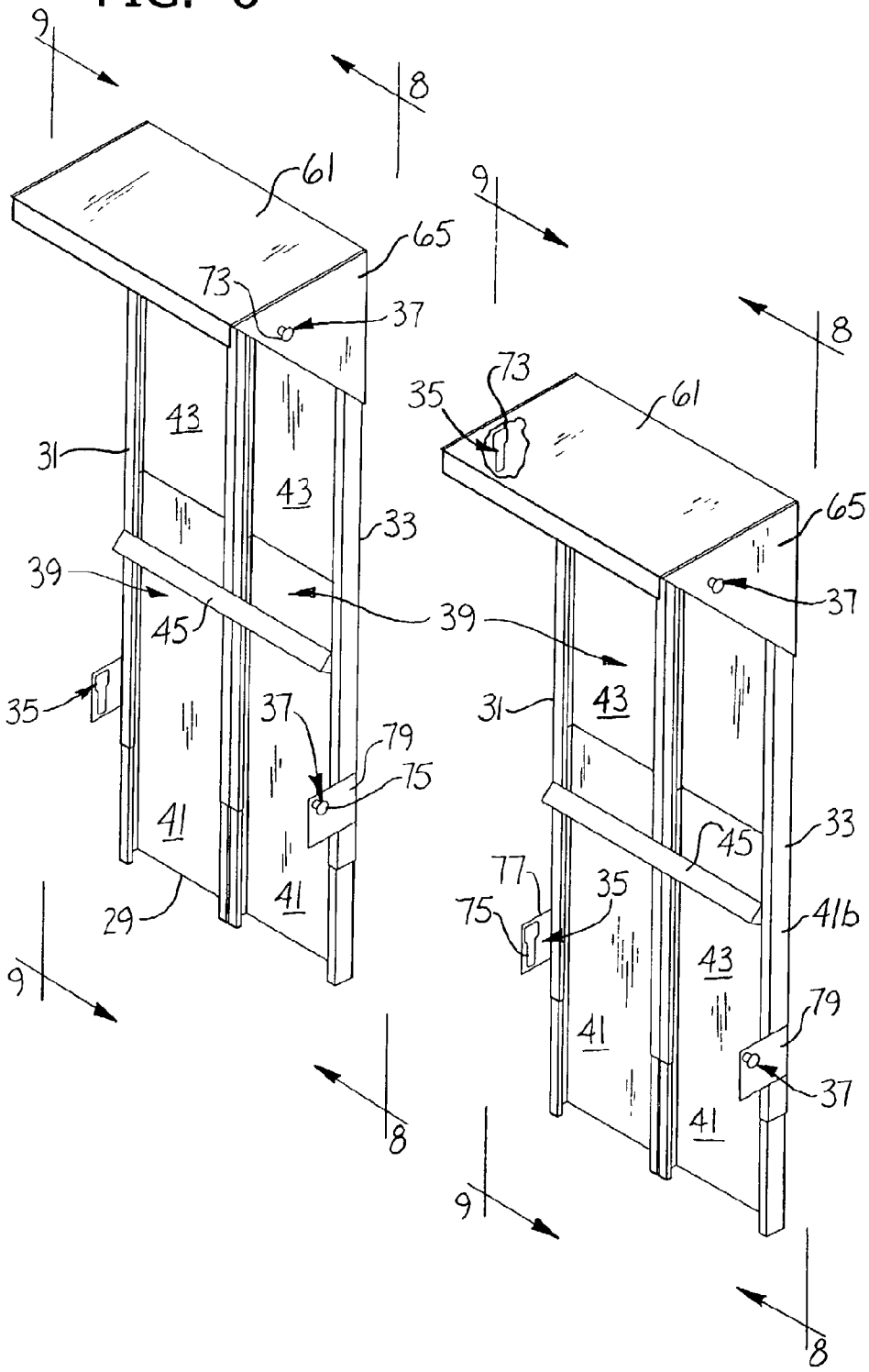
FIG. 6 is a fragmentary exploded perspective showing two sections of a side wall of the tunnel.

Referring to FIGS. 4–6, each side wall section 25 has a shelf or header 61 at the top secured on the upper ends 63 of the upper panel members 43 (see FIG. 5 particularly). The header is secured to the two upper panel members of the section 25 as by welding and may have the support of gussets 65 similar to what is shown in the aforesaid U.S. Pat. No. 6,264,549 B1. A footer (not shown), such as a channel, adapted to engage or rest on the floor may be included at the bottom end of the lower panel members 41. Alternatively, a head and head seal (not shown) similar to that shown in U.S. Pat. No. 4,820,081 (which is incorporated by reference) may be installed at the bottom end of the lower panel members 41.

The deck 23 of the tunnel 19 of this embodiment comprises several deck sections 67, e.g., at least three, and as shown the same number of sections (five) as there are tunnel side wall sections 25, each deck section 67 having a width corresponding to the width of a side wall section. Thus, for the five-section side walls 21*a*, 21*b* shown, there are five deck sections 67. However, it is contemplated that each wall section 25 be several times wider, e.g., two, three, four or five times wider, than each deck section 67. For example, there may be five deck sections resting on a single wall section. Each deck section 67 bears at its ends on the shelf or header upper end 63 and is shown as being connected to the shelf and thus to the upper panel members 43 of the two extensible panels 41 of the side wall section by pin 69 and bayonet slot 71 quick connections shown in FIG. 5 in similar manner to the deck connection shown in the aforesaid U.S. Pat. No. 5,412,916.

Referring to FIGS. 4–6, the side wall sections 25 (wall sections) in each side wall 21*a*, 21*b* are interconnected in side-by-side assembly by sets of the quick-connection elements 35, 37 on abutting sides 31 and 33 of the sections, specifically an upper set 73 and a lower set 75. As shown, and subject to variations, the quick-connection elements comprise a bayonet slot 35 at one of the one abutting sides, specifically the side 31 of a section 25, and a pin or headed stud 37 at the other abutting side, specifically the side 33 of a section 25. Also, as shown, and subject to variation, the lower bayonet slot 35 of the lower set 75 is in a rectangular plate 77 secured (as by welding) on the flange 41*b* at the side 31 of the section and the bayonet slot 35 of the upper set 73 is in the gusset 65 at side 31. The lower headed stud 37 is in a rectangular plate 79 secured (as by welding) on the flange 41*b* at the side 33 of the section and the upper pin or headed stud 37 is secured (as by welding) to the gusset 65 at side 33. Referring to FIGS. 8–11, in this embodiment each bayonet slot 35 is generally vertically oriented, having the opening 81 constituting its large end at its upper end and the relatively narrow part 83 of the bayonet slot extending down from the large end 81. Each pin or headed stud 37 comprises a stem or shank 85 extending outwardly at right angles from the part (79, 65) to which it is secured, and a head 87 on the stem or shank 85. The head 87 is somewhat smaller than the end opening 81 of bayonet slot 35 so that it may pass therethrough and the stem or shank is somewhat smaller than the narrow part 83 of the bayonet slot so as to fit therein. Quick-connection elements preferably require no tools or no loose fasteners, though less preferred quick-connection elements may require simple pounding or pulling tools (e.g., a hammer or pry bar) to form a connection. Other types of quick-connection elements than those shown are contemplated.

Figure 10:
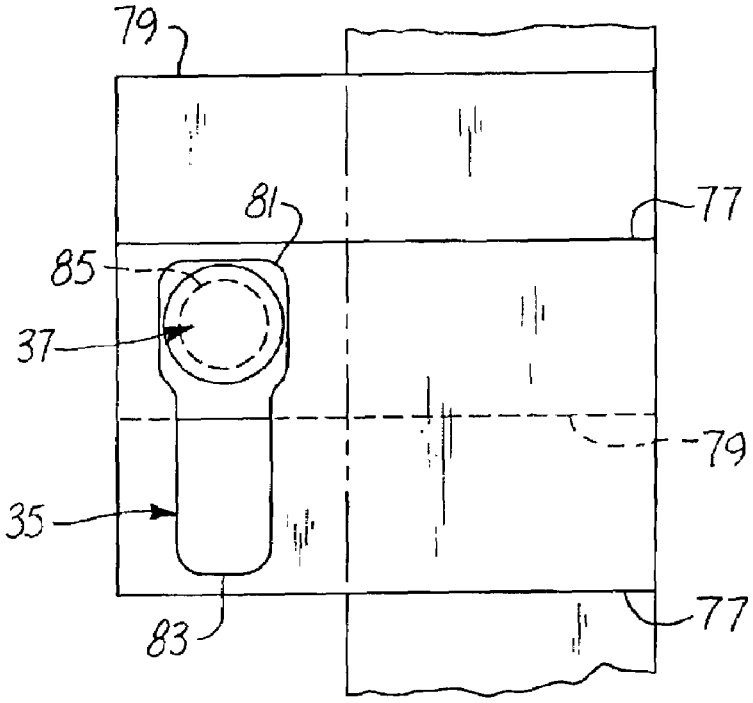
FIG. 10 is a fragmentary view illustrating procedure involved in making one of the quick-connections.
Figure 10A:
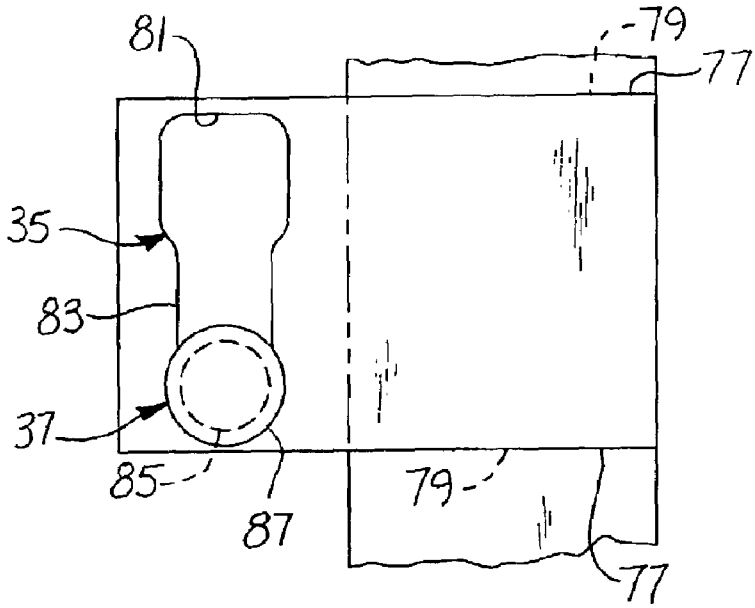
FIG. 10A is a development of FIG. 10 illustrating the quick-connection made thereby.
Figure 11:
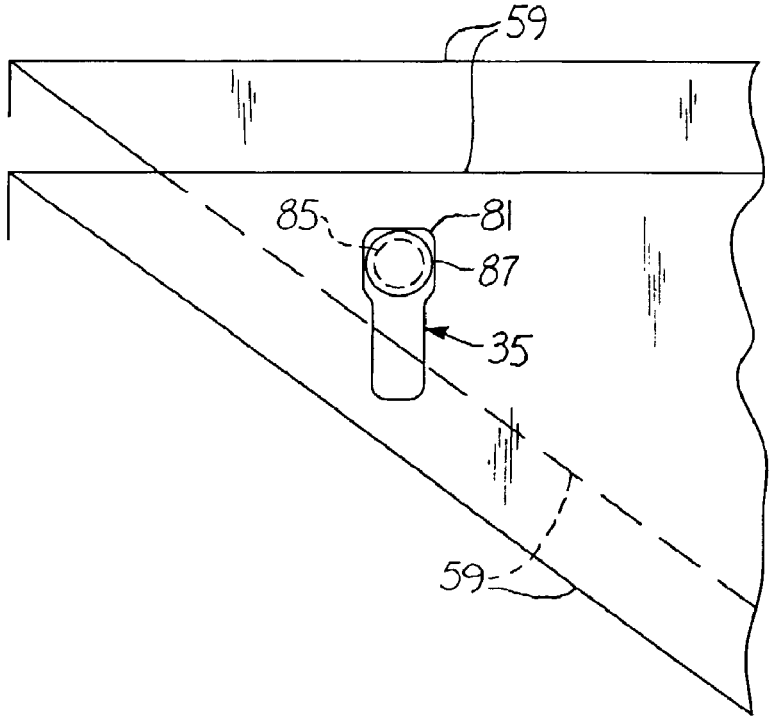
FIG. 11 is a fragmentary view illustrating procedure involved in making another of the quick-connections.
Figure 11A:
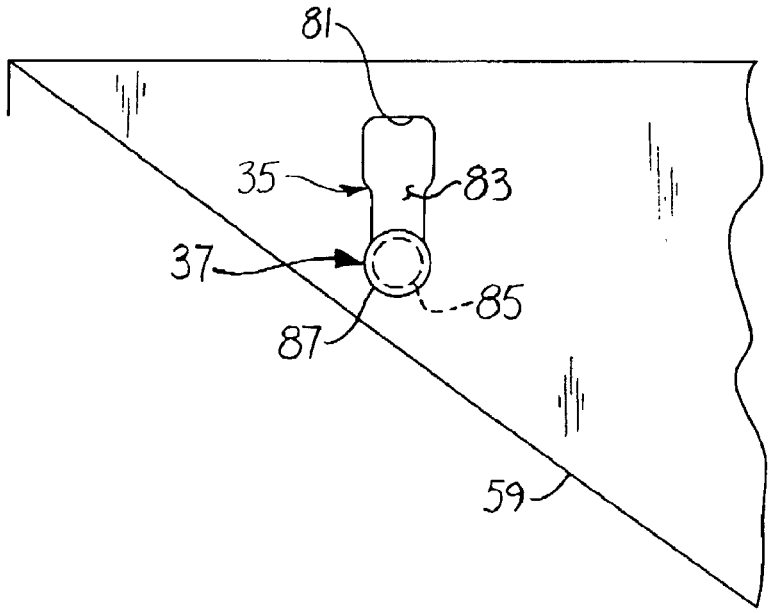
FIG. 11A is a development of FIG. 11 illustrating the quick-connection made thereby.

With respect to the tunnel 19 as completed (the method of fabrication thereof to be subsequently described), the headed studs 37 are received in the bayonet slots 35 as shown in FIGS. 10A and 11A. More particularly, the stem or shank 85 of each stud is received in the narrow part 83 of the respective bayonet slot 35, occupying the lower end region of the narrow part of the respective bayonet slot. FIG. 10A shows the interconnection of adjacent sections 25 effected by each of the lower sets of quick-connection elements 35/37; FIG. 11A shows the interconnection of adjacent sections 25 effected by each of the upper sets of quick-connection elements 35/37.

As shown in FIG. 5, each deck section 67 of this embodiment includes quick-connection elements, such as pin 69 and bayonet slot 71 quick connection elements for interconnection of adjacent deck sections in side-by-side assembly to form the deck 23. Other types of quick connection elements, including without limitation fork-shaped projections or simple cylindrical projections, are contemplated. As shown, the elements 69/71 are oriented generally vertically for connecting adjacent deck sections 67 prior to connecting the formed deck 23 to the side walls 21*a*/21*b*. Alternatively, the elements 71 for connecting adjacent deck sections 67 and for connecting the deck sections to the wall sections 25 may be oriented parallel to the longitudinal axis of the deck sections (i.e., rotated 90° from the positions shown) so that connection of a deck section to an adjacent deck section and to a wall section may be achieved simultaneously with one longitudinal movement of the deck section. It is contemplated that the connection elements between deck sections or between wall sections be other than quick-connection elements within the scope of this invention. For example, bars 45 and twist clamps may be used. Moreover, either of the deck sections or the wall sections may include no connection elements, e.g., there may be connection elements on the wall sections and not on the deck sections, within the scope of the invention.

Once the tunnel wall sections 25 and deck sections 67 have been brought into the mine and are available at the intersection of the passageways 1 and 3, a method of this invention of installing the mine overcast 17 of this invention is generally as follows. A first of the wall sections 25 (e.g. a first section 25 of side wall 21*a*) is positioned and supported generally upright but may be inclined or angled somewhat to allow for easier connection of a deck section 67. One end of the deck section 67 is lifted (i.e., lifted from the floor of the mine) and fastened on top (i.e., on shelf or header 61) of the first wall section 25 utilizing the pin 69 and bayonet slot 71 connections (FIG. 5). The other end of the deck section 67 is lifted and a second of the wall sections 25 is positioned generally upright beneath the other end of the deck section and opposite the first wall section. The other end of the deck section 67 is brought into engagement with the second wall section 25 and similarly fastened on top (i.e. on the shelf or header 61) of the second wall section, thereby forming a first subassembly of tunnel 19 having one side constituted by the first wall section and an opposite side constituted by the second wall section 25 with the deck section spanning the sides of the first subassembly. Note that this procedure automatically plumbs the first wall section 25. In one embodiment, the deck sections 67 are much narrower than the wall sections 25. In that case, more deck sections are placed atop the first and second wall sections. Thereafter, additional wall sections 25 are quick-connected side-by-side with the first and second wall sections, and deck sections 67 are then fastened thereto, to form at least one additional subassembly of the tunnel. The side-by-side quick connection is carried out by lifting wall sections 25 into a position with the sides 33 opposed to sides 31 of the first subassembly, thrusting it endwise for the reception of the headed studs 37 in the large upper end openings 81 of the bayonet slots 35 at side 31 of the first such assembly, then allowing the second subassembly to lower itself so that the stems or shanks 85 of the studs slide downward into the narrow parts 83 of the bayonet slots 35 (see FIGS. 10A and 11A). If necessary for the size of the overcast, this procedure is repeated for the quick connection of the third subassembly to the second, the fourth to the third, and the fifth to the fourth. As described in U.S. Pat. No. 6,264,549 B1, the tunnel may then be raised to the desired height of the deck and lower panel members 41 may be extended as required for the desired height, and wire ties 89 (or other suitable clamps) applied over the bar 45 as shown in FIG. 7 to hold the upper panel members 43 relative to the lower panel members. After the tunnel is complete, an end wall including wing panels and end panels as shown, for example in U.S. Pat. No. 5,466,187, may be constructed.

Other methods of installation are contemplated. For example, after a first of the wall sections 25 (e.g. a first section 25 of side wall 21*a*) is positioned, the lower panel members 41 may be extended as required for the desired height of the deck, and wire ties 89 (or other suitable clamps) applied over the bar 45 as shown in FIG. 7 to hold the upper panel members 43 relative to the lower panel members. A second of the wall sections 25 is positioned, and extended as needed, opposite the first wall section. One end of a deck section 67 is fastened on top (i.e. on shelf or header 61) of the first wall section 25 utilizing the pin 69 and bayonet slot 71 connections (FIG. 5) and the other end of the deck section 67 is similarly fastened on top (i.e. on the shelf or header 61) of the second wall section 25, thereby forming a first subassembly of tunnel 19 having one side constituted by the first wall section and an opposite side constituted by the second wall section 25 with the deck section spanning the sides of the first subassembly. Note that extension of the lower panel members 41 may be performed after the structure is completely assembled, similar to that described above and in U.S. Pat. No. 6,264,549 B1. Additional wall sections 25 are quick-connected side-by-side, and deck sections 67 are then fastened thereto, to form additional subassemblies of the tunnel.

As further examples, the deck sections 67 may be secured to one or both of the wall sections 25 prior to positioning the wall sections on the floor 7. Moreover, the deck sections 67 may be secured to one another by engaging the respective pins 69 and bayonet slots 71 as described above, or by other suitable connection means. The deck sections 67 may be simultaneously secured to the wall sections 25 or completed side walls 21*a*/21*b* in one motion as described above, or the complete deck 23 may be secured to the completed side walls.

Figure 12:
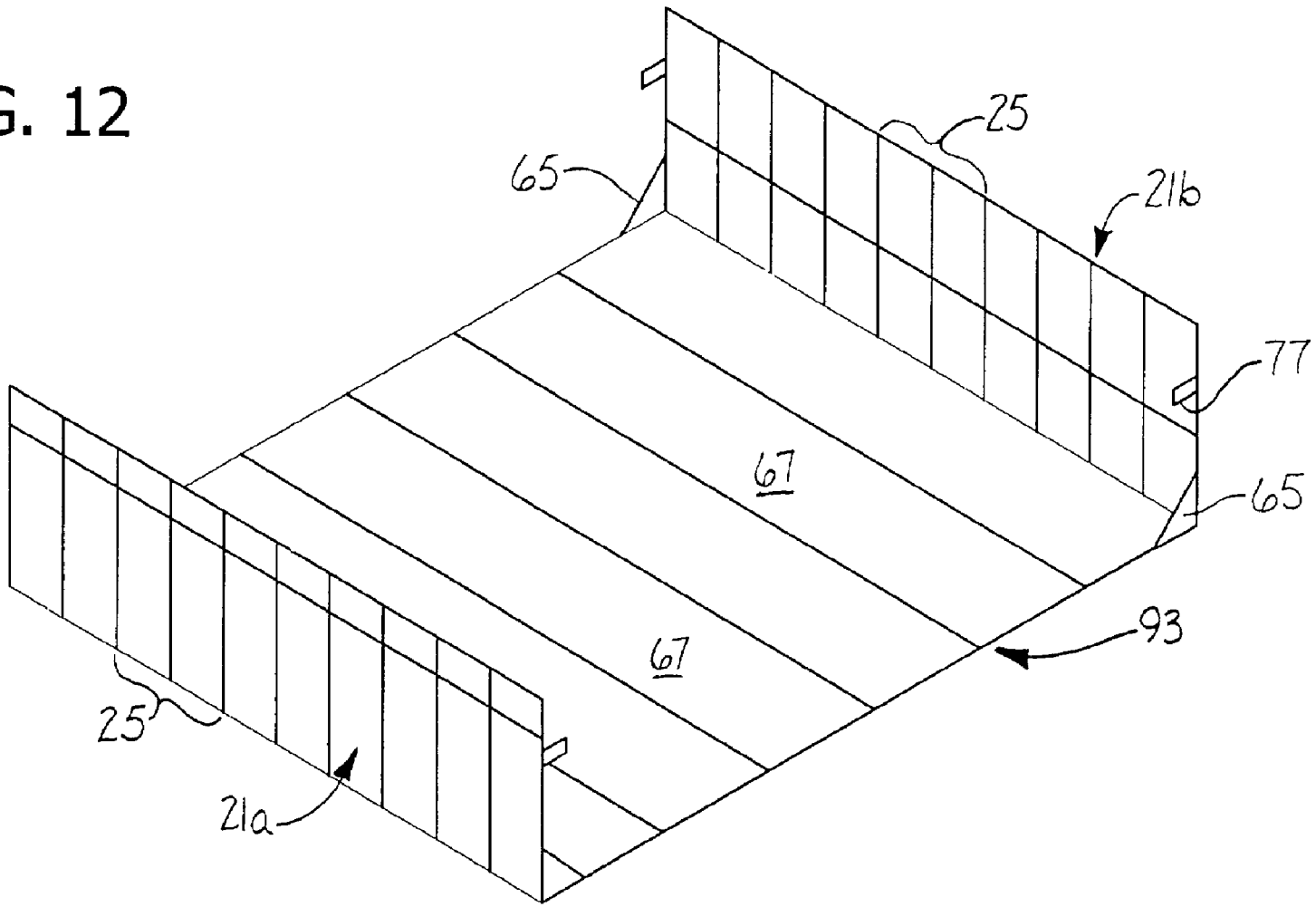
FIG. 12 is a schematic view generally in perspective of an exemplary undercast of an embodiment of the invention.

As shown schematically in FIG. 12, the deck may alternatively extend from side wall 21*a* to side wall 21*b* at or adjacent the bottom of the side walls to form an undercast 93. For an undercast 93, the deck sections 67 are placed on, for example, a prefabricated base, a masonry base or a graded cut bank (not shown), and connected together using suitable means. Note that typically when an undercast is used, air flow in one direction is between the sidewalls 21*a* above the deck, and air flow in the other direction is through the cut beneath the decks generally transverse to the longitudinal axes of the deck sections 67. As shown in FIG. 12, wall sections 25 are attached along an outermost edge of the outermost deck sections 67. These deck sections are preferably provided with slots 71 along such edges. Thus, in a preferred embodiment, the wall sections 25 and deck sections 67 are connected by engaging the pins 69 with the slots 71 as described above.

Other air crossing constructions are contemplated. For example, "end walls" made up of wall sections 25 may be added to the top of the deck to extend up to the roof, especially where the roof is extremely high. Such end walls may be turned upside down and locked into slots (not shown) in the deck sections.

In view of the above, it will be seen that the several objects of the invention are achieved and other advantageous results attained.

As various changes could be made in the above constructions and method without departing from the scope of the invention, it is intended that all matter contained in the above description and shown in the accompanying drawings shall be interpreted as illustrative and not in a limiting sense.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A mine air crossing comprising:

opposite side walls and a deck extending from side wall to side wall, each side wall comprising a plurality of sections each having a top, bottom and sides, at least one of said sections including a plurality of elongate panels, said sections in each side wall being assembled side-by-side and interconnected to form the respective side wall by quick-connections.

2. A mine air crossing as set forth in claim 1 wherein the sections are interconnected in side-by-side assembly by quick-connection elements on abutting sides of the sections.

3. A mine air crossing as set forth in claim 2 wherein the quick-connection elements comprise a bayonet slot in one abutting side and a headed stud on the other abutting side received in the bayonet slot.

4. A mine air crossing as set forth in claim 3 wherein the bayonet slot is in a plate fixed to the one abutting side and the headed stud is in a plate on the other abutting side.

5. A mine air crossing as set forth in claim 2 wherein the sections are interconnected in side-by-side assembly by an upper set and a lower set of quick-connection elements at abutting sides of the sections.

6. A mine air crossing as set forth in claim 2 wherein the sections are interconnected in side-by-side assembly by an upper set and a lower set of quick-connection elements at abutting sides of the sections, and wherein the quick-connection elements comprise a bayonet slot at one abutting side and a headed stud at the other.

7. A mine air crossing as set forth in claim 2 wherein the sections are interconnected in side-by-side assembly by an upper set and a lower set of quick-connection elements at abutting sides of the sections, and wherein the quick-connection elements comprise a bayonet slot at one abutting side and a headed stud at the other, and wherein the bayonet slot is in a plate at the one abutting side and the headed stud is on a plate at the other abutting side.

8. A mine air crossing as set forth in claim 1 wherein each section has a header extending along the top supporting the deck.

9. A mine air crossing as set forth in claim 8 wherein the deck comprises at least two deck sections interconnected by quick-connections.

10. A mine air crossing as set forth in claim 9 wherein at least some of said panels are vertically extensible.

11. A mine air crossing as set forth in claim 1 wherein the deck comprises at least two deck sections, interconnected by quick-connections and at least some of said side wall section panels are vertically extensible, the side wall sections in each side wall being interconnected in side-by-side assembly by an upper set and a lower set of quick-connection elements at abutting sides of the sections, and wherein the quick-connection elements comprise a bayonet slot at one abutting side and a headed stud at the other, and wherein the bayonet slot is in a plate at the one abutting side and the headed stud is on a plate at the other abutting side.

12. A method of installing a mine air crossing, said mine air crossing comprising opposite side walls and a deck extending from side wall to side wall, each side wall comprising a plurality of sections each having a top, bottom and sides, said sections in each side wall being assembled side-by-side and interconnected to form the respective side wall by quick-connections, said method comprising positioning a first of the side wall sections in a generally upright stance, lifting one end of a deck section and fastening said one end on the top of the first side wall section, lifting the other end of the deck section, positioning a second wall section under the other end of the deck section, fastening the other end of the deck section on the top of the second side wall section to thereby form a first subassembly of the air crossing having one side constituted by the first side wall section, an opposite side constituted by the second side wall section with the deck section spanning said sides of the first subassembly, and thereafter interengaging additional subassemblies by quick-connecting side wall sections of said subassemblies side-by-side to form the air crossing.

13. The method of claim 12 wherein the quick-connecting of the subassemblies comprises interengaging bayonet slots with headed studs.

14. The method of claim 13 wherein the stated interengagement of one subassembly with another is effected by lifting side wall sections of the one subassembly for the reception of the studs in the bayonet slots and then allowing the section to lower.

15. A method of installing a mine air crossing, said mine air crossing comprising opposite side walls and a deck extending from side wall to side wall, each side wall comprising a plurality of sections each having a top, bottom and sides, said sections in each side wall being assembled side-by-side and interconnected to form the respective side wall by quick-connections, said method comprising positioning a first of the side wall sections in an upright stance, positioning a second of the side wall sections in an upright stance opposite the first side wall section, fastening one end of a deck section on the top of the first side wall section, fastening the other end of the deck section on the top of the second side wall section to thereby form a first subassembly of the air crossing having one side constituted by the first side wall section, an opposite side constituted by the second side wall section with the deck section spanning said sides of the first subassembly, and thereafter forming additional subassemblies by quick-connecting side wall sections of said subassemblies side-by-side to form the air crossing.

16. A mine air crossing comprising:

opposite side walls and a deck extending from side wall to side wall, each side wall comprising a plurality of side wall sections, the deck comprising a plurality of deck sections, said side wall sections being assembled side-by-side and said deck sections being assembled side-by-side, at least some of said deck sections being interconnected to form the deck by quick-connections.

17. A mine air crossing as set forth in claim 16, wherein the side wall sections are interconnected in side-by-side assembly by quick-connection elements on abutting sides of the side wall sections, and the deck sections are interconnected in side-by-side assembly by quick-connection elements on abutting sides of the deck sections.

18. A mine air crossing as set forth in claim 17 wherein the quick-connection elements comprise a bayonet slot in one abutting side and a headed stud on the other abutting side received in the bayonet slot.

19. A mine air crossing as set forth in claim 18 wherein the side wall sections are interconnected in side-by-side assembly by an upper set and a lower Bet of quick-connection elements at abutting sides of the sections.

20. A mine air crossing as set forth in claim 2 wherein abutting sides of the sections are in direct contact with one another.

21. The method of claim 12 wherein the forming of the additional subassembly includes quick-connecting a deck section to the deck section of the first subassembly.

22. A mine air crossing comprising:

opposite side walls and a deck extending from side wall to side wall, each side wall comprising first and second sections, each section having a top, bottom and an abutting side, at least one of the sections including a plurality of elongate panels, the first section including a first quick-connection element fixed to its abutting side, the second section including a second quick-connection element fixed to its abutting side and interengaged with the first quick-connection element.

23. A mine air crossing as set forth in claim 22 wherein the first quick-connection element is a slot and the second quick-connection element is a stud received in the slot.

24. A mine air crossing as set forth in claim 23 wherein the slot is in a plate welded to the first section and the stud is in a plate welded to the second section.

25. A mine air crossing as set forth in claim 23 wherein each section has a header extending along the top and supporting the deck.

26. A mine air crossing as set forth in claim 25 wherein the deck comprises at least two deck sections interconnected by quick-connections.

27. A mine air crossing as set forth in claim 22 wherein at least some of said panels are vertically extensible.

* * * * *